US011958643B2

(12) United States Patent
Trygg

(10) Patent No.: US 11,958,643 B2
(45) Date of Patent: Apr. 16, 2024

(54) CARTON LOADING DEVICE COMPRISING A GRIPPER ASSEMBLY

(71) Applicant: Yaskawa Nordic AB, Torsås (SE)

(72) Inventor: Lars Trygg, Karlshamn (SE)

(73) Assignee: Yaskawa Nordic AB, Torsås (SE)

( * ) Notice: Subject to any disclaimer, the term of this patent is extended or adjusted under 35 U.S.C. 154(b) by 175 days.

(21) Appl. No.: 17/755,693

(22) PCT Filed: Nov. 8, 2019

(86) PCT No.: PCT/EP2019/080680
§ 371 (c)(1),
(2) Date: May 5, 2022

(87) PCT Pub. No.: WO2021/089170
PCT Pub. Date: May 14, 2021

(65) Prior Publication Data

US 2022/0388699 A1 Dec. 8, 2022

(51) Int. Cl.
*B65B 5/06* (2006.01)
*B65B 7/20* (2006.01)
(Continued)

(52) U.S. Cl.
CPC ..... *B65B 21/18* (2013.01); *B65B 5/06* (2013.01); *B65B 7/20* (2013.01); *B65B 35/16* (2013.01);
(Continued)

(58) Field of Classification Search
USPC ..... 53/266.1
See application file for complete search history.

(56) References Cited

U.S. PATENT DOCUMENTS 5,060,455 A 10/1991 Schmeisser

FOREIGN PATENT DOCUMENTS

CN 104443500 A 3/2015
EP 2345581 A2 7/2011
(Continued)

OTHER PUBLICATIONS

International Search Report and Written Opinion dated Jul. 31, 2020, issued in corresponding International Patent Application No. PCT/EP2019/080680, filed Nov. 8, 2019, 10 pages.

*Primary Examiner* — Chinyere J Rushing-Tucker
(74) *Attorney, Agent, or Firm* — Christensen O'Connor Johnson Kindness PLLC

(57) ABSTRACT

The invention concerns a carton loading device (1) comprising a gripper assembly (20), which comprises at least one gripper (21) arranged to grip a product item (P) from above and to lower the product item (P) into a carton (10). The carton (10) comprises along first parallel sides (11) thereof comprises bottom side flaps (13) and top side flaps (14) and along second parallel sides (12) thereof comprises bottom end flaps (15) and top end flaps (16) and is presented to the gripper assembly (20) in a sleeve state with all flaps (13-16) unfolded. The gripper assembly (20) comprises a pinching means (22) arranged to pinch and hold the top side flaps (14) of the carton (10) and to hold and move the carton (10) and said product item (P) jointly to a carton closing station of the carton loading device (1), where the gripper assembly (20) finally releases said product item (P) and the carton (10) once the bottom side flaps (13) and the bottom end flaps (15) have been folded in and secured.

12 Claims, 6 Drawing Sheets

(51) Int. Cl.

| | |
|---|---|
| ***B65B 21/18*** | (2006.01) |
| ***B65B 35/16*** | (2006.01) |
| ***B65B 35/36*** | (2006.01) |
| ***B65B 43/46*** | (2006.01) |
| ***B65B 43/54*** | (2006.01) |

(52) U.S. Cl.
CPC ..... *B65B 35/36* (2013.01); *B65B 43/46* (2013.01); *B65B 43/54* (2013.01)

(56) References Cited

FOREIGN PATENT DOCUMENTS

| | | | | |
|---|---|---|---|---|
| FR | 2298478 | A1 | 8/1976 | |
| NL | 8 801 904 | A | 2/1990 | |
| WO | WO-9607592 | A2 * | 3/1996 | ..... B65B 59/005 |

* cited by examiner

CARTON LOADING DEVICE COMPRISING A GRIPPER ASSEMBLY

TECHNICAL FIELD

The present invention concerns a carton loading device comprising a gripper assembly, which comprises at least one gripper arranged to grip and hold a product item from above and to lower the product item from above into a carton, wherein the carton along first parallel sides thereof comprises bottom side flaps and top side flaps and along second parallel sides thereof comprises bottom end flaps and top end flaps.

PRIOR ART

Carton loading devices according to the preamble are generally known as top loading devices, such as the device revealed in U.S. Pat. No. 5,060,455. In these devices product items, such as bottles, are by means of a gripper assembly from above placed in an open carton, which has been erected beforehand such that there is a carton bottom for the product items to rest upon.

An advantage of such devices is that they are quite versatile and easy to adapt to different product items and carton sizes, especially if the gripper assembly is manipulated by means of a robot, which is the preferred solution according to U.S. Pat. No. 5,060,455.

One general drawback of the known top loading devices is that the erection of cartons from blanks beforehand requires a separate station, and another drawback is that the erected cartons require large space, which renders the known devices both complicated and bulky.

OBJECT OF THE INVENTION

In the light of the above it is an object of the present invention to improve a carton loading device according to the preamble such that the device is rendered simpler and less bulky than its prior art predecessors.

SUMMARY OF THE INVENTION

In a carton loading device according to the preamble, the object of the invention is achieved in that the gripper assembly is arranged to move said product item from a pick-up station of the carton loading device to a carton loading station thereof and and to lower said product item into the carton while the carton in the carton loading station is presented in a sleeve state with all flaps unfolded, wherein the gripper assembly comprises a pinching means arranged to pinch and hold the top side flaps of the carton in the carton loading station, wherein the gripper assembly is arranged to hold and move the carton and said product item jointly to a carton closing station of the carton loading device, and wherein the gripper assembly is arranged to release said product item and the carton once the bottom side flaps and the bottom end flaps have been folded in and secured.

By using cartons which in the carton loading station are presented in a sleeve state and to fill them while both their top and bottom is open, it is rendered possible to feed flat folded carton blanks into the carton loading station and to unfold each blank to its sleeve state just before said at least one product item is inserted therein. Hence, no space has to be provided in the carton loading device for empty open cartons that have been erected beforehand. Further, contrary to before, the folding and securing of the bottom and top flaps of each filled carton can now be performed in a single carton closing station arranged after the carton loading station. This too renders the carton loading device more compact and simpler than the prior art solutions.

Preferably, the pinching means of the carton loading device comprises two parallel anvils, which are arranged to externally enclose the top side flaps of the carton, and two plungers, which are arranged to be moved towards one anvil each to pinch the top side flaps. The proposed pinching solution is a very simple one that makes it easy for the carton loading device according to the invention to safely pinch and hold the open carton while it is being filled and while it is moved to the carton closing station.

Preferably, the anvils of the carton loading device comprise outwardly bent bottom guide flanges. These guide flanges improve reliability of the carton loading device as they serve to steer the top side flaps to the position in which they can safely be pinched.

Preferably, the gripper assembly of the carton loading device comprises a plurality of grippers, which are arranged in at least two rows defined by gripper blocks, which are arranged to run in parallel with the first parallel sides of the carton. The grippers as such can for instance be suction grippers or bottle grippers, which are arranged in a matrix pattern comprising for instance for blocks with six grippers each and hold that much product items, such as packages or bottles, that the carton is totally filled in the carton loading station.

Preferably, the gripper blocks of the carton loading device are arranged to be moved outwardly in the carton loading station in order to fully expand the carton. This is advantageous as the carton in that way always receives a well defined shape, which is good for appearance and renders folding of the bottom and top flaps easier and more reliable.

Preferably, the plungers and gripper blocks of the carton loading device are arranged to be moved in common by means of a single cylinder arrangement acting on both. This solution serves to simplify the carton loading device and improves reliability as fewer components can get broken.

Preferably, the carton loading device further comprises a carton gripper, which is arranged to move a filled and closed carton from the carton closing station to a carton storage station of the carton loading device, wherein the carton gripper comprises a pair of parallel side walls, which define a space in which a closed carton fits and of which at least one is displaceable towards or away from the other to grip or release a closed carton. By integrating such a carton gripper, the carton loading device according to the invention becomes even more versatile and self contained and therefore very easy to install for instance in a production line of a brewery, where individual bottles are fed into the carton loading device and pallets loaded with stacked cartons are fed out of the carton loading device.

Preferably, the side walls of the carton gripper of the carton loading device are displaceable by means of a cylinder assembly arranged on top of said space. By this a filled carton can be safely held and the carton gripper easily be adapted to different carton sizes.

Preferably, one of the side walls of the carton gripper comprises a bottom catch, which is rotatable about an axis in parallel with a bottom margin of said one side wall and capable of being rotated in under a bottom edge of a carton to secure the carton within said space and of being rotated out from said bottom edge to allow the carton to slide out of said space. This solution serves to minimize the pressure needed to safely hold the carton.

Preferably, the catch of the carton gripper is rotatable by means of a cylinder assembly arranged on a side wall outside of said space. This solution is easy to accomplish and does not interfere with other structures of the carton loading device or with the space reserved for cartons held by the carton gripper.

Preferably, the gripper assembly and the carton gripper of the carton loading device are in common arranged on a mount, which comprises a robot interface of a robot forming part of the carton loading device. As indicated before, robot solutions are very versatile ones and are easily adaptable to different carton loading situations that may occur.

BRIEF SUMMARY OF THE DRAWINGS

A preferred embodiment of the invention is shown schematically on the appendant drawings, in which.

DETAILED DESCRIPTION OF THE PREFERRED EMBODIMENT

Figure 5:
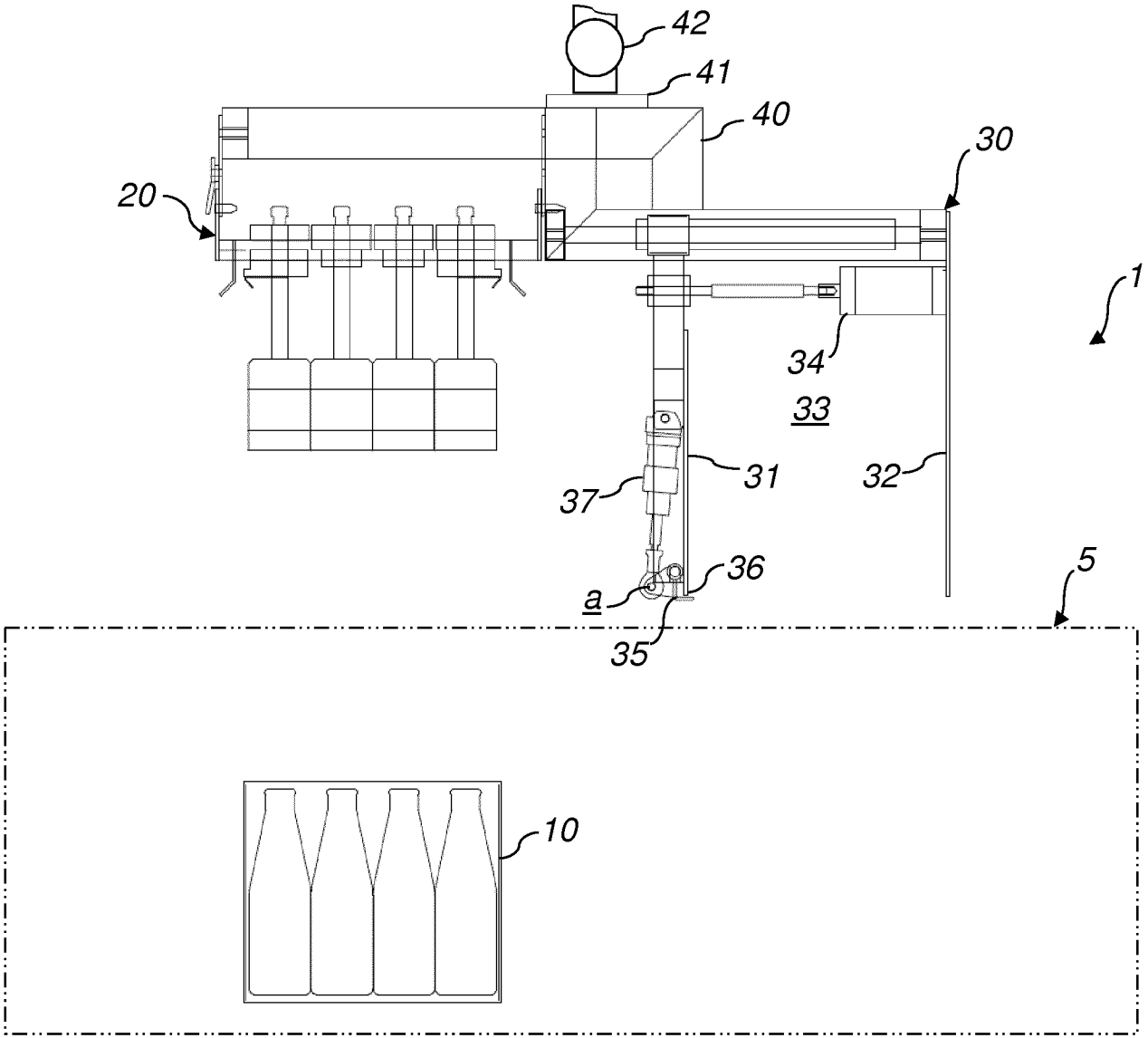
FIG. 5 is an elevational view of the gripper assembly and a carton gripper arranged side by side on a common mount, which is attached to a robot.

The carton loading device 1 shown in the drawings is best implemented when used in conjunction with an industrial robot, which is indicated in FIG. 5, where reference number 42 symbolically indicates part of a robot and reference number 41 an interface between that robot 42 and the carton loading device 1. As further indicated in FIG. 5, the carton loading device preferably comprises two sub-units, namely a gripper assembly 20 and a carton gripper 30, both of which are mounted on a common mount 40 that comprises the robot interface 41. Below the two sub-units 20, 30 and their function are described in detail with reference mainly to FIGS. 1-4 and to FIGS. 5-8, respectively.

Figure 1:
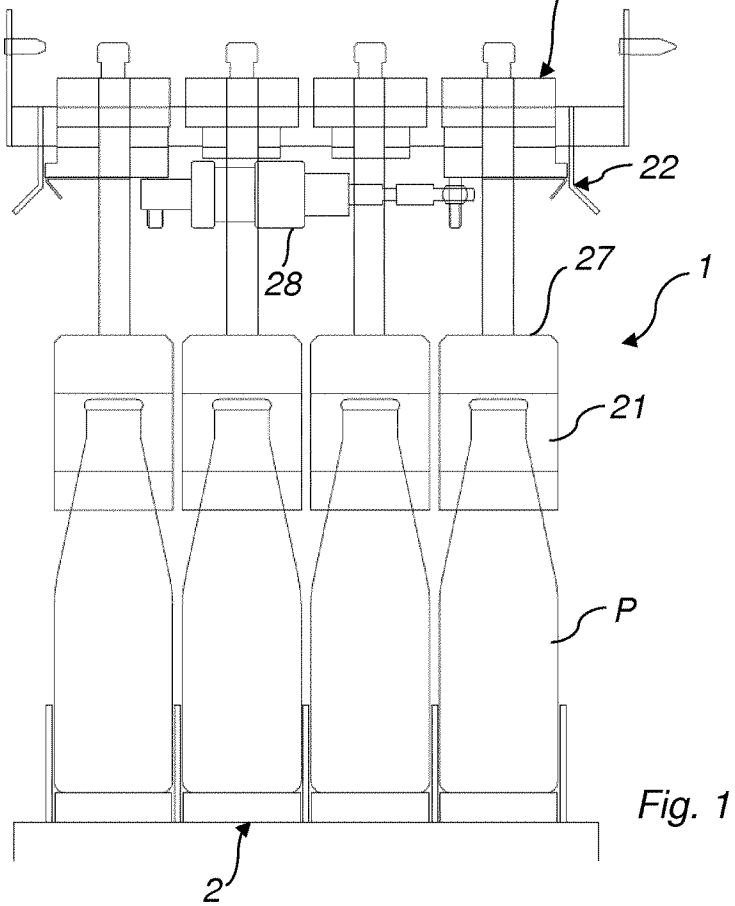
FIG. 1 is an elevational view of a gripper assembly gripping bottles in a pick-up station of the carton loading device.
Figure 4:
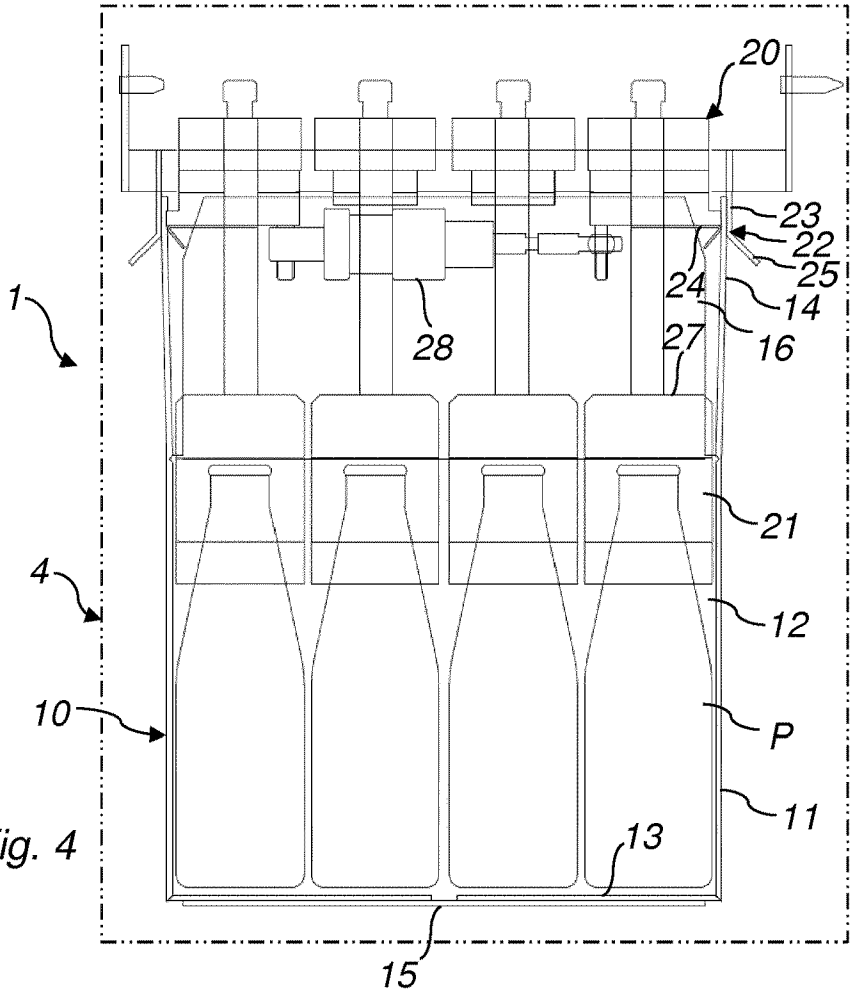
FIG. 4 is an elevational view of the gripper assembly with the gripped bottles in a carton closing station of the carton loading device.

The gripper assembly 20 is according to the preferred embodiment arranged to handle bottles, which are indicated P and serve as a good example of a product item to be loaded into a carton by a carton loading device. The bottles P are in a pick-up station 2 (c.f. FIG. 1) of the carton loading device 1 arranged in a matrix pattern comprising for instance four times six bottles P. To pick the bottles P up, the gripper assembly 20 has a corresponding number of grippers 21, which are arranged in a corresponding matrix pattern of four grippers 21 in each row and six grippers 21 in each column, wherein the six grippers 21 in each column are united in gripper block 27 each. The blocks 27 are displaceable to and from each other by means of a cylinder assembly 28, which is arranged on top of the grippers 21 and acts on the outermost blocks 27. Obviously, displacement of the blocks 27 causes displacement of the four grippers 21 in each row as well such that bottles P, held by the grippers 21 of each row can be moved to and from each other.

Figure 2:
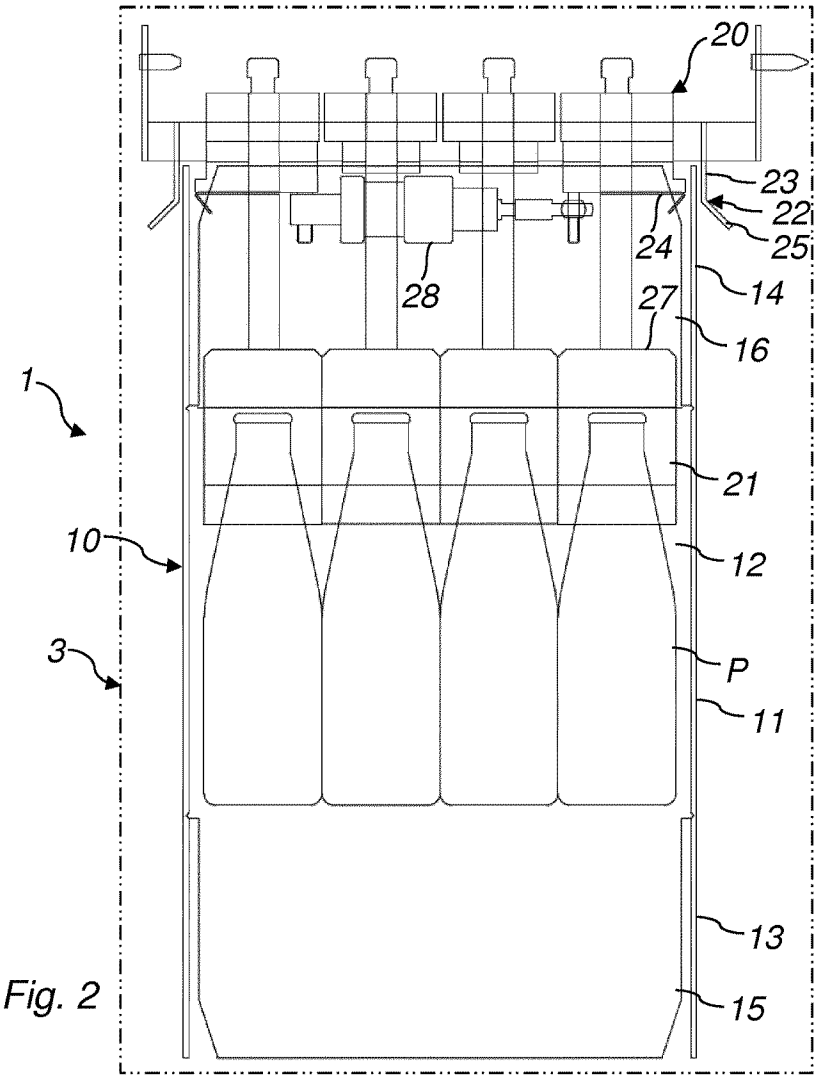
FIG. 2 is an elevational view of the gripper assembly with the gripped bottles during a first loading step in a carton loading station of the carton loading device.
Figure 3:
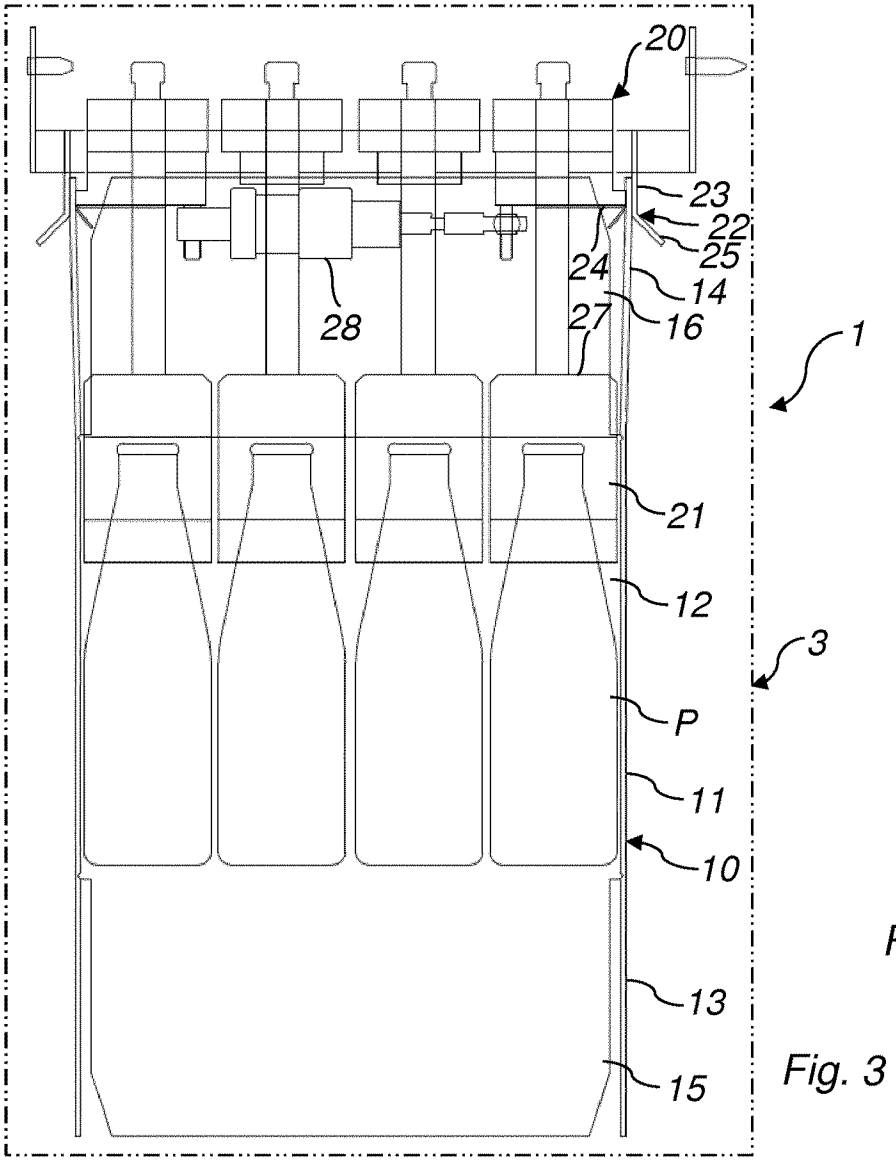
FIG. 3 is an elevational view of the gripper assembly with the gripped bottles during a second loading step in the carton loading station of the carton loading device.

In FIGS. 2 and 3 a next station of the carton loading device 1 is illustrated symbolically by means of a dashed outline 3. The station 3 is a carton loading station to which the bottles P picked up in the pick-up station 2 are moved next by means of the robot 42. In the carton loading station 3 a carton 10 is provided, which comes from a magazine (not shown) that in a well known way comprises a great number of folded carton blanks. The carton 10 provided in the carton loading station 3 is an unfolded carton blank, which, as shown, along first parallel sides 11 comprises bottom side flaps 13 and top side flaps 14 and along second parallel sides 12 comprises bottom end flaps 15 and top end flaps 16. The carton 10 is in FIG. 2 held by means of for instance a suction cup or the like, which is well known in the art an hence not illustrated.

After having been picked up in the pick-up station 2, the bottles P in each row of four are moved closer to each other by contraction of the blocks 27 by means of the cylinder assembly 28. By this it is rendered easier to (as shown in FIG. 2) insert the bottles P from above into the carton 10, which in the carton loading station 3 is presented in a sleeve state with all flaps 13-16 unfolded.

When the bottles P are fully inserted in the carton 10, a pinching means 22, which is arranged to pinch and hold the top side flaps 14 of the carton 10 in the carton loading station 3, comes to use. The pinching means 22 comprises two parallel anvils 22, which, as shown, at their bottom comprise outwardly bent bottom guide flanges 25. The flanges 25 serve to facilitate insertion of the top side flaps 14 inside of the anvils 23 so that these come to externally enclose the top side flaps 14 of the carton 10. The pinching means 22 further comprises two plungers 23, which are arranged inside of the anvils 23 and inside the top side flaps 14 of the carton 10 when the bottles P are fully inserted therein. The plungers 23 are connected to the outermost blocks 27 and are displaceable together with these by means of the cylinder assembly 28.

In FIG. 3 the blocks 27 and the bottles P attached thereto have been moved apart by means of the cylinder assembly 28. By this the carton 10 is fully expanded and shaped, which is important since that improves the quality of the final filled carton 10. Moving the blocks 27 apart, affects the plungers 24 as well. Hence, as shown in FIG. 3, the plungers 24 do now press the top side flaps 14 of the carton 10 towards one anvil 23 each to pinch and hold these top side flaps 14.

Next, by the robot 42 the gripper assembly 20 moves the carton 10, held by pinching its the top side flaps 14, together with the bottles P, held by the grippers 21, to a next station of the the carton loading device 1. This next station is a carton closing station 4, which is schematically illustrated by means of a dashed and dotted outline. The carton closing station 4 is not described in detail, as it comprises means well known in the art to fold and secure flaps of cartons, such as guides or plungers, by which flaps of a carton can be folded, and glue or tape dispensers or staplers, by which the folded flaps are finally secured.

Once a filled carton 10 has been closed, it has to be moved to a next station o the carton loading device 1. This next station is a carton storage station 5, which is schematically illustrated by means of a dashed and dotted outline in FIGS. 5-8. For moving the carton 10 to the carton storage station 5 the carton loading device comprises a carton gripper 30, which like the gripper assembly 20 is mounted on the mount 40 mentioned before.

The carton gripper 30 comprises a pair of parallel side walls 31, 32, which define a space 33 in which a closed carton 10 fits. It further comprises a cylinder assembly 34 arranged on top of the space 33 occupied by the carton 10. By means of the cylinder assembly 34 the left hand side wall 31 in the drawings can be moved towards or away from the other side wall 32 in order to grip or release a closed carton 10 in a controlled way.

Figure 6:
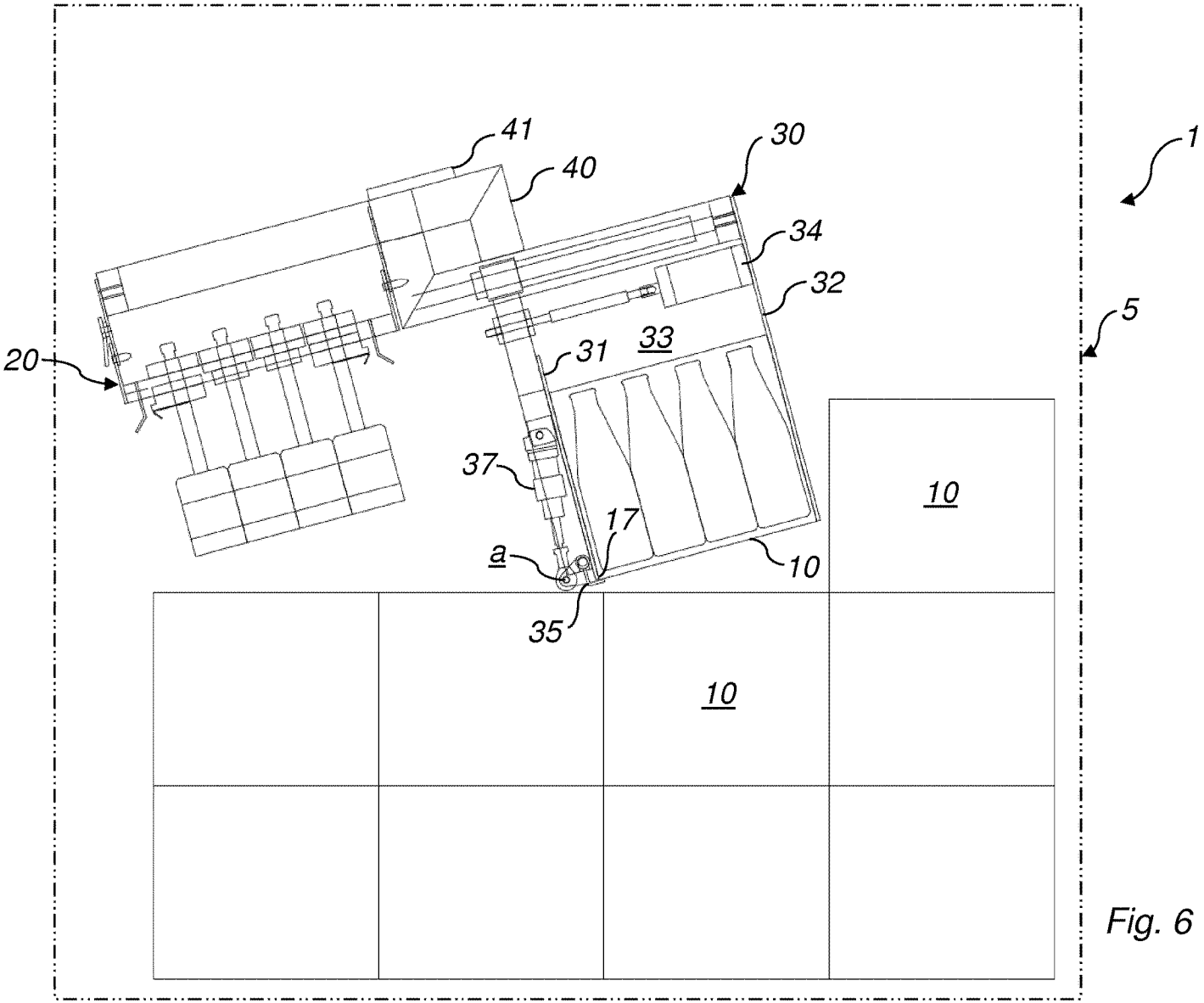
FIG. 6 is an elevational view of the carton gripper while placing a carton on a stack of cartons in a storage station of the carton loading device.
Figure 7:
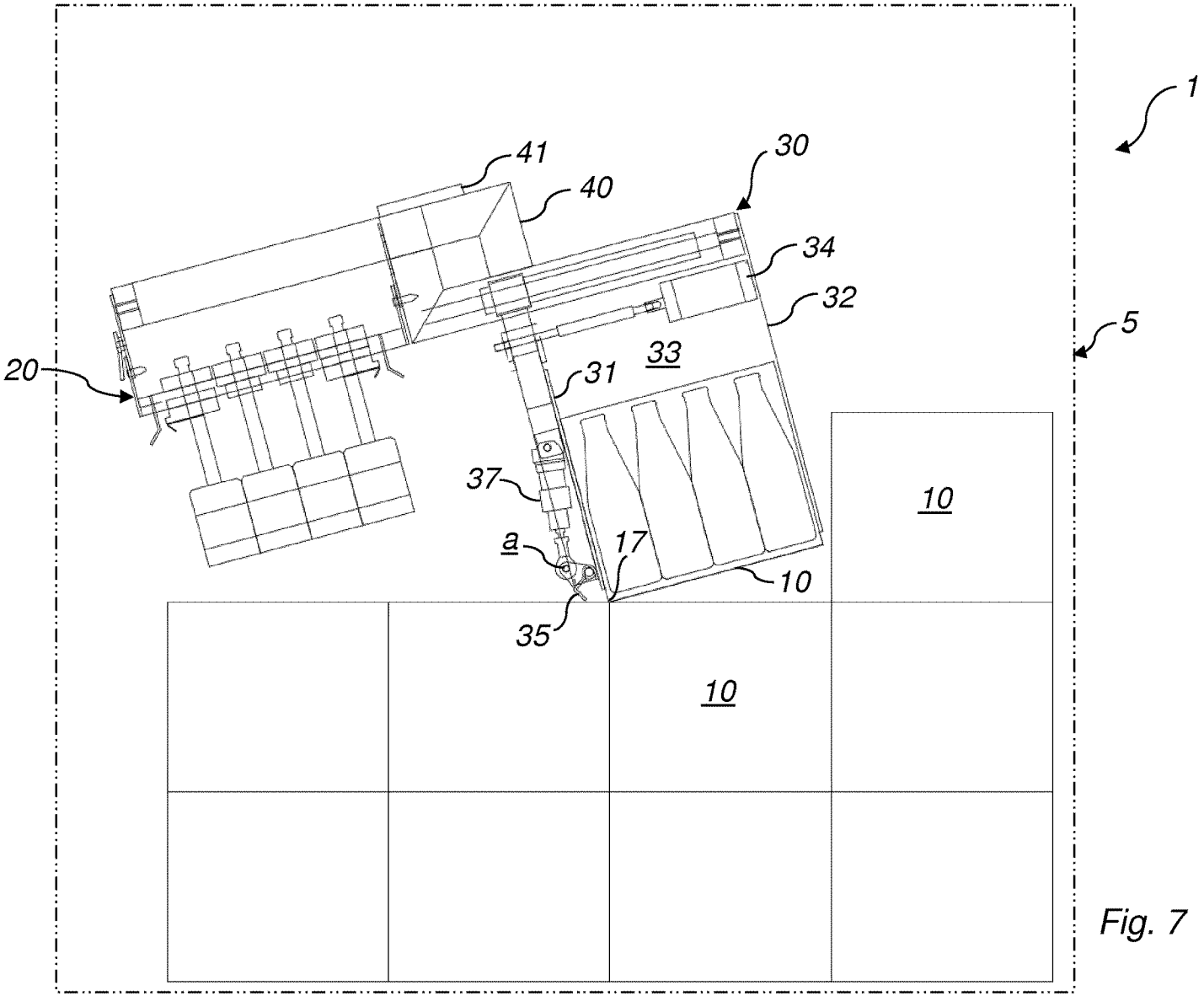
FIG. 7 is an elevational view of the carton gripper while letting the carton slide onto the stack of cartons in the storage station of the carton loading device.
Figure 8:
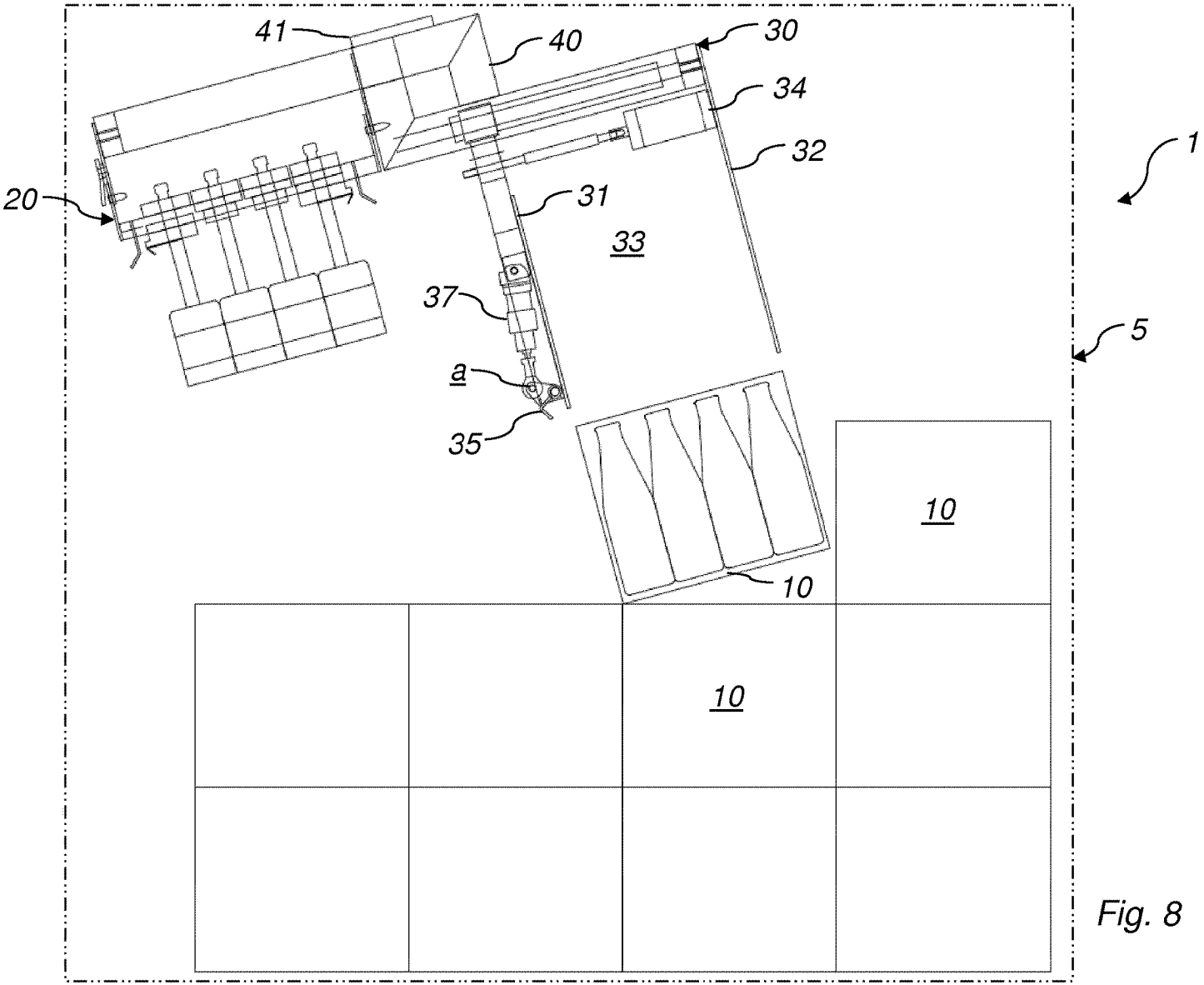
FIG. 8 is an elevational view of the carton gripper while finally releasing the carton onto the stack of cartons in the storage station of the carton loading device.

At a bottom margin 36 the side wall 31 comprises a bottom catch 35, which is rotatable about an axis a in parallel with said bottom margin 36 by means of a cylinder assembly 37 arranged on the side wall 31 outside of said space 33. The catch 35 is capable of being rotated in under a bottom edge 17 of a closed carton 10, such as illustrated in FIG. 6, in order to secure the carton 10 within said space 33, and of being rotated out from said bottom edge 17, such as illustrated in FIGS. 7 and 8, to allow the carton 10 to slide out of said space 33 onto a stack of cartons 10. Hence, the carton loading device 1 according to the preferred embodiment of the invention is by means of a single robot 42 capable of filling and closing cartons 10 as well as of stacking the closed cartons 10 on each other.

The invention claimed is:

1. A carton loading device comprising a gripper assembly, which comprises at least one gripper arranged to grip and hold a product item from above and to lower the product item from above into a carton, wherein the carton along first parallel sides thereof comprises bottom side flaps and top side flaps and along second parallel sides thereof comprises bottom end flaps and top end flaps, characterized in that the gripper assembly is arranged to move said product item from a pick-up station of the carton loading device to a carton loading station thereof and to lower said product item into the carton while the carton in the carton loading station is presented in a sleeve state with all flaps unfolded, that the gripper assembly comprises a pinching means arranged to pinch and hold the top side flaps of the carton in the carton loading station, that the gripper assembly is arranged to hold and move the carton and said product item jointly to a carton closing station of the carton loading device, and that the gripper assembly is arranged to release said product item and the carton once the bottom side flaps and the bottom end flaps have been folded in and secured.

2. The carton loading device according to claim 1, wherein the pinching means comprises two parallel anvils, which are arranged to externally enclose the top side flaps of the carton, and two plungers, which are arranged to be moved towards one anvil each to pinch the top side flaps.

3. The carton loading device according to claim 2, wherein the anvils comprise outwardly bent bottom guide flanges.

4. The carton loading device according to claim 2, wherein the plungers and gripper blocks are arranged to be moved in common by means of a single cylinder assembly acting on both.

5. The carton loading device according to claim 1, wherein the gripper assembly comprises a plurality of grippers, which are arranged in at least two rows defined by gripper blocks, which are arranged to run in parallel with the first parallel sides of the carton.

6. The carton loading device according to claim 5, wherein the gripper blocks are arranged to be moved outwardly in the carton loading station in order to fully expand the carton.

7. The carton loading device according to claim 6, wherein the plungers and gripper blocks are arranged to be moved in common by means of a single cylinder assembly acting on both.

8. The carton loading device according to claim 1, further comprising a carton gripper, which is arranged to move a filled and closed carton from the carton closing station to a carton storage station of the carton loading device, wherein the carton gripper comprises a pair of parallel side walls, which define a space in which a closed carton fits and of which at least one is displaceable towards or away from the other to grip or release a closed carton.

9. The carton loading device according to claim 8, wherein the side walls of the carton gripper are displaceable by means of a cylinder assembly arranged above said space.

10. The carton loading device according to claim 8, wherein one of the side walls comprises a bottom catch, which is rotatable about an axis in parallel with a bottom margin of said one side wall and capable of being rotated in under a bottom edge of a carton to secure the carton within said space and of being rotated out from said bottom edge to allow the carton to slide out of said space.

11. The carton loading device according to claim 10, wherein the catch is rotatable by means of a cylinder assembly arranged on a side wall outside of said space.

12. The carton loading device according to claim 1, wherein the gripper assembly and the carton gripper are in common arranged on a mount, which comprises a robot interface of a robot forming part of the carton loading device.

* * * * *